US008201818B2

(12) United States Patent
Ueda et al.

(10) Patent No.: US 8,201,818 B2
(45) Date of Patent: Jun. 19, 2012

(54) SHEET FEEDING APPARATUS AND IMAGE FORMING APPARATUS PROVIDED WITH SHEET FEEDING APPARATUS

(75) Inventors: Daisuke Ueda, Hachioji (JP); Akira Kosugi, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 39 days.

(21) Appl. No.: 12/466,507

(22) Filed: May 15, 2009

(65) Prior Publication Data

US 2009/0289410 A1 Nov. 26, 2009

(30) Foreign Application Priority Data

May 22, 2008 (JP) ..... 2008-134054

(51) Int. Cl.
*B65H 3/14* (2006.01)

(52) U.S. Cl. ..... 271/98; 271/97

(58) Field of Classification Search ..... 271/97, 271/98

See application file for complete search history.

(56) References Cited

U.S. PATENT DOCUMENTS

| | | | | |
|---|---|---|---|---|
| 5,344,133 | A * | 9/1994 | Jantsch et al. | 271/94 |
| 5,620,176 | A * | 4/1997 | Spoorenberg et al. | 271/98 |
| 7,140,605 | B2 * | 11/2006 | Suga et al. | 271/97 |
| 7,451,973 | B2 * | 11/2008 | Koga et al. | 271/97 |
| 7,621,521 | B2 * | 11/2009 | Koga et al. | 271/97 |
| 7,637,491 | B2 * | 12/2009 | Hiura | 271/97 |
| 2007/0001372 | A1 * | 1/2007 | Hiura | 271/11 |
| 2007/0045932 | A1 * | 3/2007 | Koga et al. | 271/97 |
| 2007/0235924 | A1 * | 10/2007 | Kimura | 271/265.01 |

FOREIGN PATENT DOCUMENTS

| | | | |
|---|---|---|---|
| JP | 4-23747 | A | 1/1992 |
| JP | 2000-203733 | A | 7/2000 |
| JP | 2003-182873 | A | 7/2003 |

* cited by examiner

*Primary Examiner* — Michael McCullough
(74) *Attorney, Agent, or Firm* — Holtz, Holtz, Goodman & Chick, PC

(57) ABSTRACT

A sheet feeding apparatus is provided with a sheet feeding device 60, a first air blow device 40 to blow air towards a side edge of a sheet bundle and a sheet side regulation member 71. The sheet side edge regulation member is provided with an air outlet 72 to blow air towards the side edge of the sheet bundle and an exhaust outlet 73 to exhaust air accumulated between a sheet separated from the sheet bundle and the sheet bundle.

6 Claims, 11 Drawing Sheets

SHEET FEEDING APPARATUS AND IMAGE FORMING APPARATUS PROVIDED WITH SHEET FEEDING APPARATUS

This application is based on Japanese Patent Application No. 2008-134054 filed on May 22, 2008, in Japanese Patent Office, the entire content of which is hereby incorporated by reference.

BACKGROUND OF THE INVENTION

The present invention relates to a sheet feeding apparatus which separates a sheet from a sheet bundle stacked in a sheet tray and an image forming apparatus.

TECHNICAL FIELD

In recent years, there is an increase of demands for image forming on a smooth surface sheet such as a coated sheet (for example, art paper and coat paper) whose surface is subject to a coating process for glazing and for increasing whiteness to meet requirements of colorizing of the market. Also, due to diversification of recording media, demands for image forming on an OHP paper and a tracing paper are increasing. The above OHP paper, tracing paper and coat paper have a high degree of smoothness, thus if the sheets are stacked in a high humidity environment, the sheets stick each other, which have resulted in a problem that miss feeding due to non feeding occurs frequently in an image forming apparatus employing a conventional sheet feeding device.

A high quality paper for general use and a regular paper recommended by a copying machine manufacturer have a low degree of surface smoothness, thus there has been no problem that the papers stick each other and causes miss feed when the paper is fed one by one from sheets stacked in a sheet storing section. Therefore, in the conventional image forming apparatus designed with an assumption that the regular paper is mainly used, miss feed is avoided by increasing a friction coefficient between a sheet feeding roller and the sheet so that one sheet on the top of the stacked sheets is fed without fail.

Also, in order to prevent the possibility that two or more sheets are fed, a separating roller, a separating pad or a separation pawl, push back a second sheet or later so that only one sheet on the top can be fed.

On the other hand, in a sheet feeding apparatus to feed a coated paper or a plain paper, there is suggested a sheet separating mechanism to separate the sheets by passing air between the sheets. In the sheet handling mechanism thereof, air blows towards an upper part of the sheet bundle from an air outlet provided at a side edge regulation member to regulate the side edges at a leading side of the stacked sheet bundle in a sheet feeding direction. Also, there is suggested another sheet separating mechanism to separate the sheet by passing air between the sheets, wherein air blows towards an upper part of the sheet bundle from an air outlet provided at a downstream side of the stacked sheet bundle in the sheet feeding direction.

Further, as a method to send the sheet separated by the sheet separating mechanism one by one, there is also suggested a sheet sending out mechanism to convey the sheet wherein the sheet on the top is adhered onto a conveyance belt by air suction, thereafter the transfer belt is moved while suctioning the sheet.

In a technology of Patent Document 1: U.S. Pat. No. 3,855,512, air blows towards the stacked sheet bundle from a downstream side of the sheet conveyance direction or air blows laterally in a direction perpendicular to a sheet conveyance direction so as to pass the air between the sheets for separating the sheets.

In a technology of Patent Document 2: U.S. Pat. No. 3,891,405, a sheet separating mechanism is provided to blow air towards the sheet bundle form an upstream side in the sheet conveyance direction. Further, a pressure member to restrict an upper surface of sheet side edge sections is provided at a sheet side edge regulation member so that the air passed between the sheets blows towards an upstream side in the sheet conveyance direction. Also there is disclosed an auxiliary sheet separating mechanism to supplementarily blow air sideways towards the sheet bundle.

In a technology described in Patent Document 3: unexamined Japanese patent application publication No. H4-23747, there is disclosed a sheet separating mechanism to blow air into the sheets at upper part of the sheet bundle, wherein an air outlet to blow air is provided at a sheet side edge regulation member to regulate one side edge of the stacked sheet bundle. In order to flow the air from the side edge smoothly to the other side edge, there is provided a pressure member to press an upper surface of the sheet bundle at an upstream side and a downstream side of the sheet in the sheet feeding direction so as to prevent the air flowing in from flowing out through the upstream side and the downstream side of the sheet in the sheet feeding direction. Namely, the pressure member is to restrict a posture of the sheet so as to prevent the upstream side and the downstream side of the sheet in the conveyance direction from being unseated from the sheet bundle by air pressure.

Patent Document 1: U.S. Pat. No. 3,855,512

Patent Document 2: U.S. Pat. No. 3,891,405

Patent Document 3: unexamined Japanese patent application publication No. H4-23747

In the sheet feeding apparatus using the above sheet separating mechanism, the air from the air outlet blows towards a downstream section of the stacked sheet bundle in the sheet feeding direction and flows between the sheets of the sheet bundle so as to separate sheets sticking each other. Whereby, a separated area between the separated sheets gradually expands from an air outlet side to the upstream side in the sheet conveyance direction.

Therefore, in the sheet feeding apparatus, a configuration that the aforesaid separated area spread towards the upstream side in the sheet conveyance direction efficiently is important.

FIG. 8 is a perspective view of a sheet feeding apparatus 300 provided with an efficient separation mechanism wherein separation between the sheets smoothly spreads towards the upstream side.

An arrow a shows a feeding direction of sheet.

The sheet feeding apparatus 300 is provided with a first air blow device 40, a second air blow device 50, a sheet suction conveyance device 60 and a sheet side edge regulation member 71 at a periphery of the sheet bundle P stacked on a sheet feeding tray 31.

The first air blow device 40 blows air towards an side edge of the sheet bundle P so as to separate a sheet P1 on the top position from the sheet bundle P, which blows air by a blower fan 41.

The second air blow device 50 blows air towards an edge section at a front end side of the sheet bundle P to assist separation by the first air blow device 40, which is disposed at a downstream side of the sheet bundle P in the sheet conveyance direction (at the front end side of the sheet bundle P).

The sheet suction conveyance device 60, being withdrawn in FIG. 8, is disposed above the sheet bundle P with a distance at a starting point of an arrow in practice. The sheet suction conveyance device 60 suctions a sheet P1 on the top lifted by the air from the first air blow device 40 and the second air blow device 50, and thereafter conveys the suctioned sheet P1 in a direction of arrow a.

The sheet side edge regulation member 71 to restrict the side edge section which is perpendicular to the sheet feeding direction of the sheet bundle P is supported by an unillustrated mechanism movably in a direction perpendicular to the sheet feeding direction, and provided with a first air outlet 72 to blow air form the first air blow device 40 as well.

The sheet side edge regulation member 71 configures a wind breakage wall so that the air from the first air blow device 40 and the second air blow device 50 does not flow out from the side edge side of the sheet bundle P. Namely, the sheet side edge regulation member 71 has a wall configuration not having openings except the first air outlet 72.

As the result, separation between the sheets by air spreads towards the downstream side in the sheet conveyance direction smoothly and an efficient separation mechanism is realized.

However, there has occurred a problem that as the strength of air blow towards the sheet bundle P is gradually enhanced so that separation performance is enhanced for a sheet having a high degree of smoothness, frequency of occurrence of duplicative feed is gradually increased.

By strong air blow, sheet separation performance was enhanced since non feed did not occur, however, on the other hand, there was occurred a new problem that the frequency of occurrence of duplicative feed gradually increased for a sheet of a high degree of smoothness with a low rigidity.

Mechanism of occurrence of the aforesaid duplicative feed will be described as follow.

FIGS. 9*a*, 9*b* and 9*c* show postures of a sheet on the top position separated from the sheet bundle by air flow and air blowing towards the sheet bundle P. FIG. 9*a* is a view of the sheet bundle stacked on the sheet feeding tray 31 of the sheet feeding apparatus 300 observed form above, where the sheet suction conveyance device 60 (inside the broken lines) is a transparent image.

An arrow a shows a sheet feeding direction, and an arrow V1 shows a flow of air exhausted from a first air outlet 72. An arrow V2 shows an air flow exhausted from the second air blow device 50.

Since the air from arrows V1 and V2 is blocked to flow out from the side edge side of the sheet bundle P by the sheet side edge regulation member 71, the air merges and forms a flow towards an opposite direction of the sheet feeding direction (a rear end of the sheet bundle P). In particular, air flow beneath the top sheet P1 is shielded by the sheet P1 at the upside and shielded by the sheet bundle P or a sheet P2 below the sheet P1 at the lower side, and further, the air is securely blocked by the sheet side regulation member 71 at both sides.

Therefore, separation between the sheets by air spreads towards the rear of the sheet smoothly.

FIG. 9*b* and FIG. 9*c* are center cross-sectional views of the sheet feeding apparatus 300 in FIG. 9*a* and FIG. 11 is a magnified view of the cross-section thereof.

FIG. 9*b* shows a case where sheets having less adhesive force between the sheets are charged and a posture of the top sheet P1 separated from the sheet bundle P.

As FIG. 9*b* shows, the sheet P1 is lifted above the sheet bundle P substantially parallel. Since the rear end of the sheet P1 is restricted by the sheet rear edge regulation member 33, the sheet surface at a front end side of the sheet P1 is suctioned by the sheet suction conveyance device 60 at a predetermined position.

As above, in case of the sheet bundle configured with the sheets having less adhesion force between the sheets, an ideal air separation performance is realized.

FIG. 9*c* shows a posture of the sheet P1 on the top position in case the sheets having a large adhesion force between the sheets are charged. Broken line show an initial stage where the sheet P1 is separated from the sheet bundle P, and a solid line shows a later stage where the sheet P1 is separated to the rear end of the sheet P1.

In a stage where the rear end side has not been separated, the separated sheet P1 on the top position is lifted by an pressure applied to a lower surface of the sheet P1 as the broken lines show, and bent as the figure shows. Therefore, the front end of the sheet P1 is suctioned at a position deviated from a correct position by d towards an upstream side (rear end side). Then by suctioning the sheet P1, an air suction action of the sheet suction conveyance device 60 does not completely stop and remains.

FIG. 10 is a schematic diagram showing a state wherein the sheet P1 shown by FIG. 9*c*, separated from the sheet bundle P through the first air bow device 40 and the second air blow device 50, is suction and conveyed through the sheet suction conveyance device 60 to a downstream side of the sheet feeding apparatus 300. FIG. 10 shows a state where a sheet P2 is separated and lifted subsequently to the sheet P1 on the top position and a sheet P3 is further separated and lifted.

FIG. 10*a* shows a state where the sheet P2 and the sheet P3 lift at a correct position when the sheet P1 is suctioned at the position deviated from a correct position by d to a rear end side as FIG. 9*c* shows.

The front end section of the sheet P2 is subject to suction action of the sheet suction conveyance device 60 and firmly adhered onto the sheet suction conveyance device 60. By suctioning the sheet P2, air suction action of the sheet suction conveyance device 60 is completely cut off, thus the sheet P3 cannot benefit from suction action of the sheet suction conveyance device 60, and then the sheet P3 is separated and lifted from the sheet P2 by the air flow between the sheet P2 and sheet P3 from the second air blow device 50. FIG. 10*b* shows the above state.

Since the suction action is always being operated during sheet feeding operation, the suctioning state of the sheet P1 and the sheet P2 is maintained. On the other hand, the sheet P3 remains in a floating condition where the sheet P3 is not positioned.

Under the condition such as FIG. 10*b*, when belt conveyance of the sheet suction conveyance device 60 starts, the sheet P1 and the sheet P2 are suctioned by the sheet suction conveyance device 60 and conveyed together to the downstream side in the sheet conveyance direction as FIG. 10*c* shows. The aforesaid belt conveyance is carried out by rotation of a large diameter roller 61 on which a suction belt 63 shown in FIG. 11 is installed.

The sheet P3 remains in the sheet feeding apparatus 300. When the rear end of the sheet P1 is ejected from the sheet feeding apparatus 300, the sheet P3 is suctioned by the sheet suction conveyance device 60 as a new sheet P1 on the top position.

As above, in an air separation sheet feeding apparatus which blows air strongly towards the sheet-bundle by using the sheet side end regulation member having a wall surface through which air cannot pass, an object of the present invention is to provide a technology to prevent a sheet having particularly a high smoothness and a less rigidity from duplicative feed while maintaining a stable posture of the sheet separated from the sheet bundle.

In a technology disclosed in the Patent Document 1, the sheets are separated by blowing air towards the stacked sheet bundle from a downstream side in a sheet conveyance direction or laterally in a direction perpendicular to the sheet conveyance direction so that the air passes between the sheets. However, the posture of the sheet separated and duplicative feed representing the subjects of the present invention are not disclosed.

In a technology disclosed in the Patent document 2, the posture of the sheet is restricted by pressing side edge section of the sheet from above by a pressing member so that the sheet does not lift. However, duplicative feed representing the subject of the present invention is not disclosed and the technology does not intend to prevent duplicative feed.

In a technology disclosed in the Patent document 3, the posture of the sheet is restricted by a pressing member so that the sheets in the upstream side and the downstream side of the sheet in the sheet conveyance direction does not lift from the sheet bundle by air pressure. However, duplicative feed representing the subject of the present invention is the technology does not intend to prevent duplicative feed.

SUMMARY

An object of the present invention is to provide a sheet feeding apparatus compatible with various kinds of sheets, which securely separates the sheets having a high smoothness by blowing strong air towards the sheet bundle and prevents duplicative feed.

To achieve the above object, the sheet feeding apparatus reflecting one aspect of the present invention comprises: a sheet feeding tray to stack a sheet bundle configured with a plurality of sheets; a sheet feeding device to convey the sheet one by one from a top position of the sheet bundle stacked on the sheet tray; a first air blow device to flow air between the sheets by blowing air towards a side edge of the sheet bundle so as to separate the sheet from the sheet bundle; and a sheet side regulation member to regulate a side edge of the sheet bundle; wherein an air outlet to blow air from the first air blow device towards the side edge of the sheet bundle and an exhaust outlet to exhaust air accumulated between the sheet separated from the sheet bundle and the sheet bundle are provided at the sheet side edge regulation member.

BRIEF DESCRIPTION OF THE DRAWINGS

These and other objects, advantages and features of the invention will become apparent from the following description thereof taken in conjunction with the accompanying drawings in which.

DETAILED DESCRIPTION OF PREFERRED EMBODIMENTS

Preferred embodiments of the present invention will be described with reference to the drawings without the present invention being limited to the embodiments to be described.

The embodiment of the present invention will be described based on the drawings.

[Image Forming Apparatus]

Figure 1:
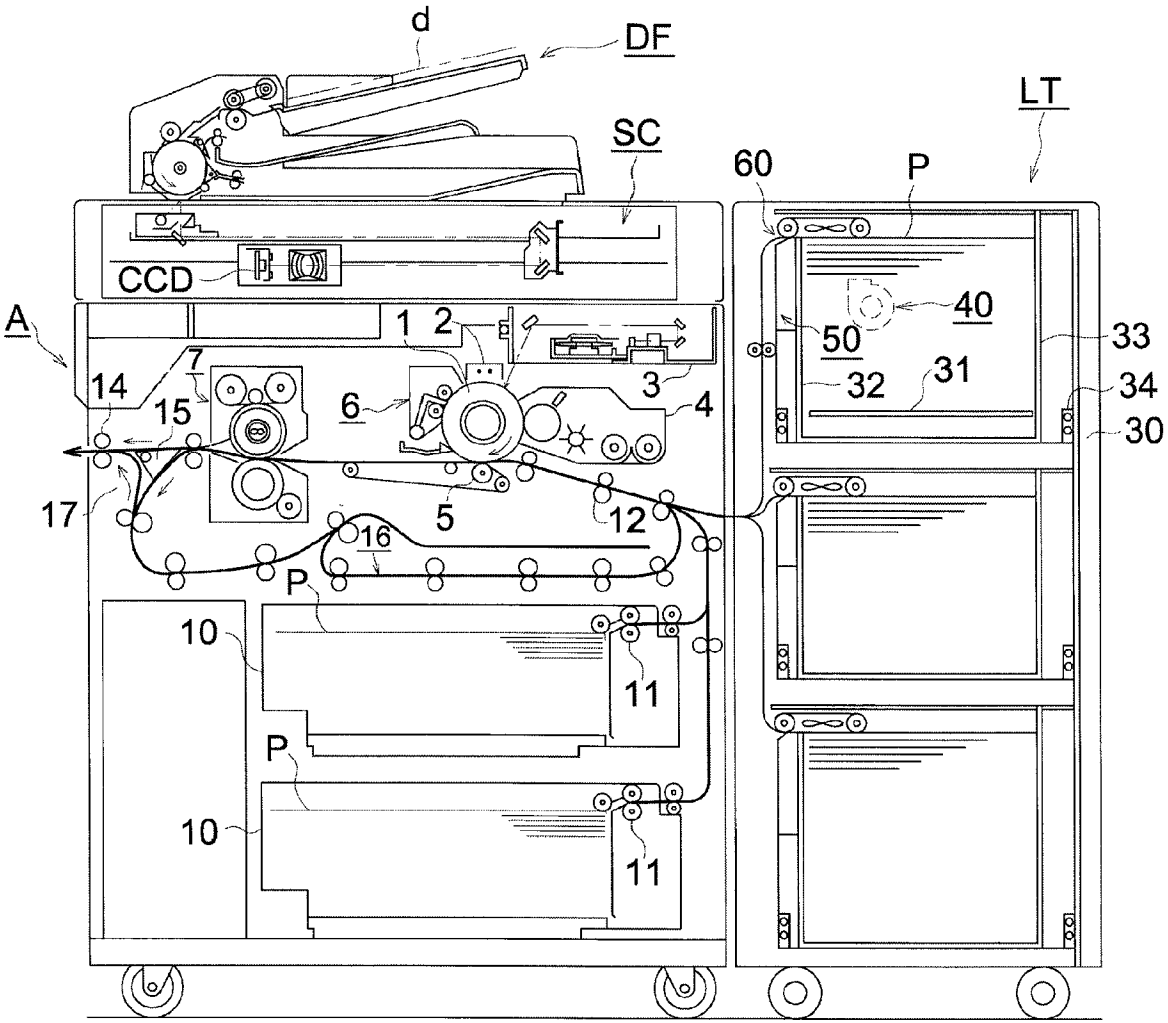
FIG. 1 is a frame format of an image forming apparatus configured with an image forming apparatus main body, an image reading apparatus, an automatic document feeding apparatus, and a large capacity sheet feeding apparatus.

FIG. 1 is a frame format an image forming apparatus configured with an image forming apparatus main body A, an image reading apparatus SC, an automatic document feeding apparatus DF, and a large capacity sheet feeding apparatus, LT.

The image forming apparatus main body A in the figure is configured with an image forming section equipped with a photo conductive body (image carrier) 1, a charging device 2, an image wise exposing device 3, a developing device 4, a transfer device 5, a cleaning device 6 and so forth, and a fixing device 7 and a sheet conveyance system.

The sheet conveyance system is configured with a sheet feeding cassette 10, a first sheet feeding device 11, a second sheet feeding device 12, a sheet ejection device 14, a conveyance path changeover device 15, a sheet recurrence re-feeding device 16 and a reversal sheet ejection device 17.

The document d placed on a document table of the automatic document feeding apparatus Df is conveyed through a sheet feeding device, an image or images on one side or both sides of the document d is read by an optical system of the image reading apparatus SC, and the image is acquired by an image sensor CCD. An analogue signal converted through photoelectro conversion by the image sensor CCD is subject to processes such as an analogue process, A/D conversion, shading correction, and image compression, then an image signal is sent to the image wise exposing device 3.

In the image forming device, processes such as charging, exposing, developing, transferring, separating and cleaning are performed.

In the image forming device, the charging device 2 charges the photo conductive body 1, an electrostatic latent image is formed by a laser beam radiation from the image wise exposing device 3, and a toner image (in the present embodiment, the toner carries a negative charge) is formed by visualizing the electrostatic latent image through the developing device 4. Next, a sheet stored in the sheet feeding cassette 10 is conveyed from the first sheet feeding device 11. On the other hand, the cleaning device 6 removes residual toner of transfer from the photoconductive body 1.

The sheet, synchronized with the toner image by the second sheet feeding device 12 configures with a regulation roller, is conveyed. Thereafter, the toner image is transferred on the sheet through the transfer device 5 and fixed by the fixing device 7. The sheet after fixing is ejected to outside the apparatus through a sheet ejection device 14.

Meanwhile, in case of double side copy, the sheet having an image formed on the first surface thereof is sent to the sheet recurrence re-feeding device 16 to be reversed, then after image forming on the second surface by the image forming device again, the sheet is ejected outside the apparatus through the sheet ejection device 14. In case of reverse sheet ejection, the sheet diverges from an ordinary ejection path and is turned over by switchback through the sheet reversal ejection device 17 and then ejected outside the apparatus through the sheet ejection device 14.

The large capacity sheet feeding apparatus LT connected to the image forming apparatus main body A, is equipped with a sheet feeding apparatus main body 30, a first air blow device 40, a second air blow device 50, and a sheet suction conveyance device (sheet feeding device) 60. The image forming apparatus main body A stores a large amount of sheets and feeds the sheet to the image forming apparatus main body A one by one.

The sheet feeding apparatus main body 30 is provided with a sheet feeding tray 31, a sheet front edge regulation member 32, a sheet rear edge regulation member 33, and a guide rail 34. The sheet tray 31 is configured with three stages and each tray is configured to be pulled out from the large capacity sheet feeding apparatus LT through the guide rail 34. For example, in the large capacity sheet feeding apparatus LT, a first tray can store 1300 sheets, and a second tray and a third tray can store 1850 sheets respectively, thus a total of about 6000 sheets can be stored.

Figure 2:
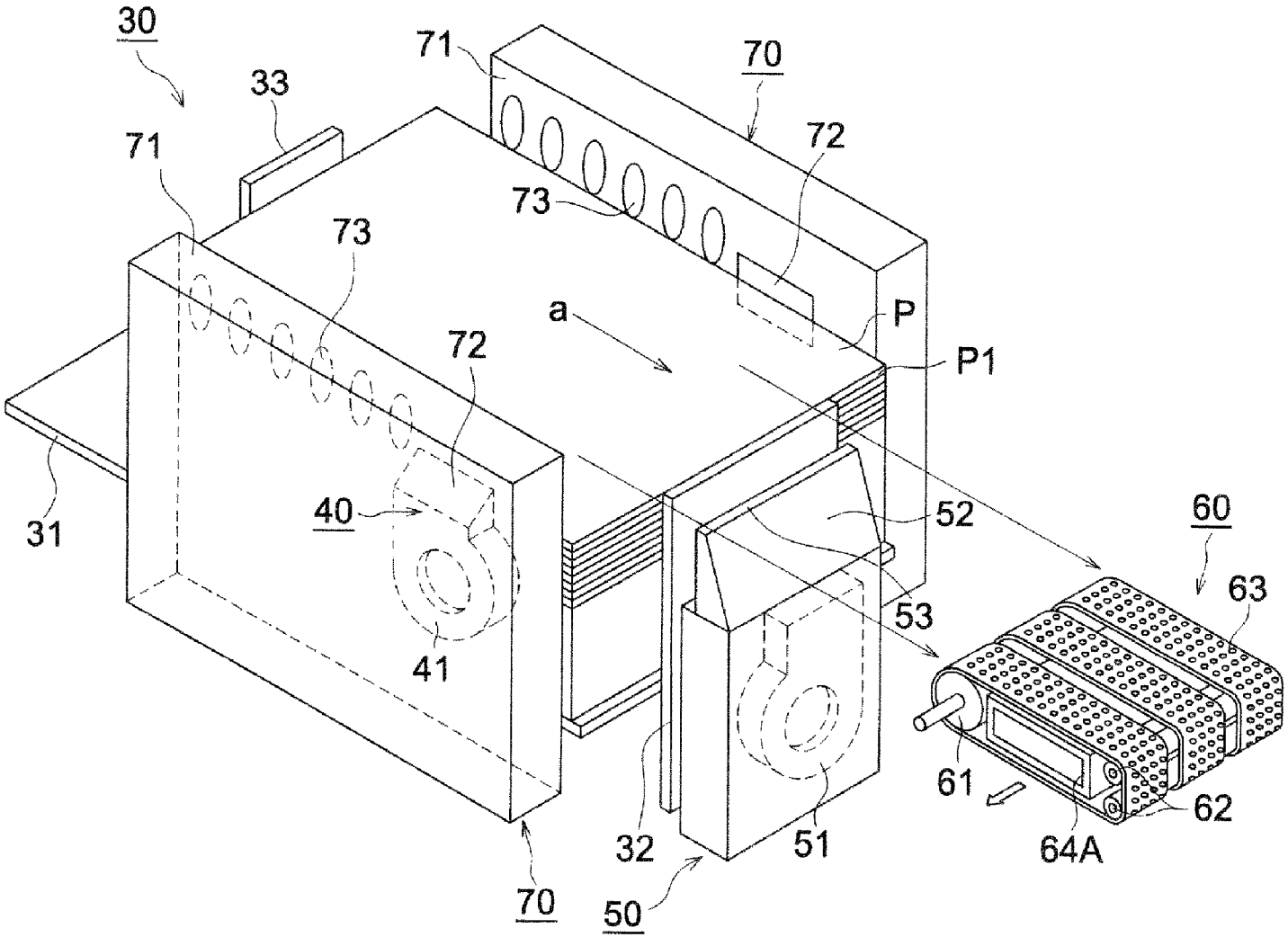
FIG. 2 is a perspective view showing relevant sections of the large capacity document feeding apparatus.
Figure 3:
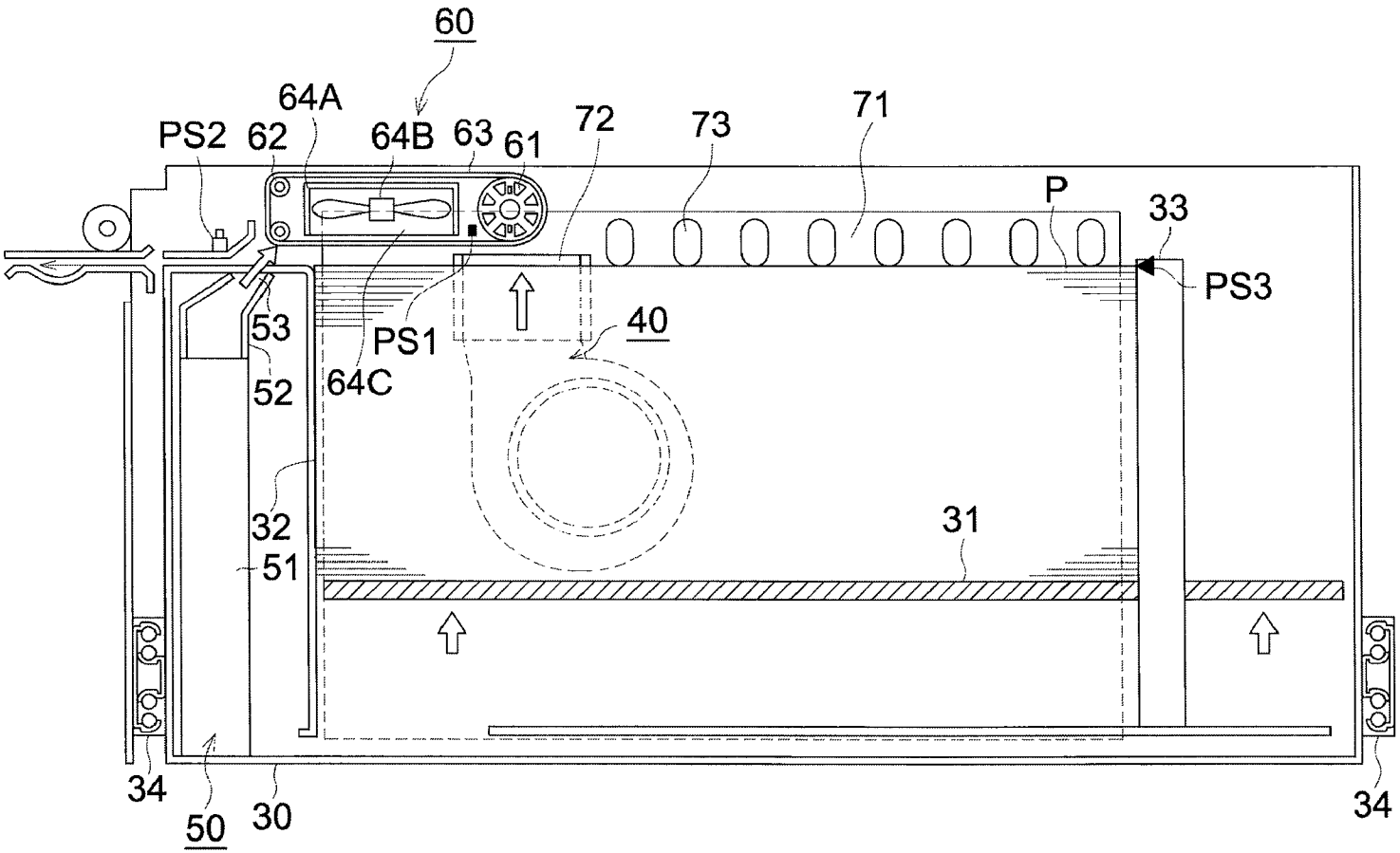
FIG. 3 is a front center cross-sectional view of the sheet feeding apparatus.
Figure 4:
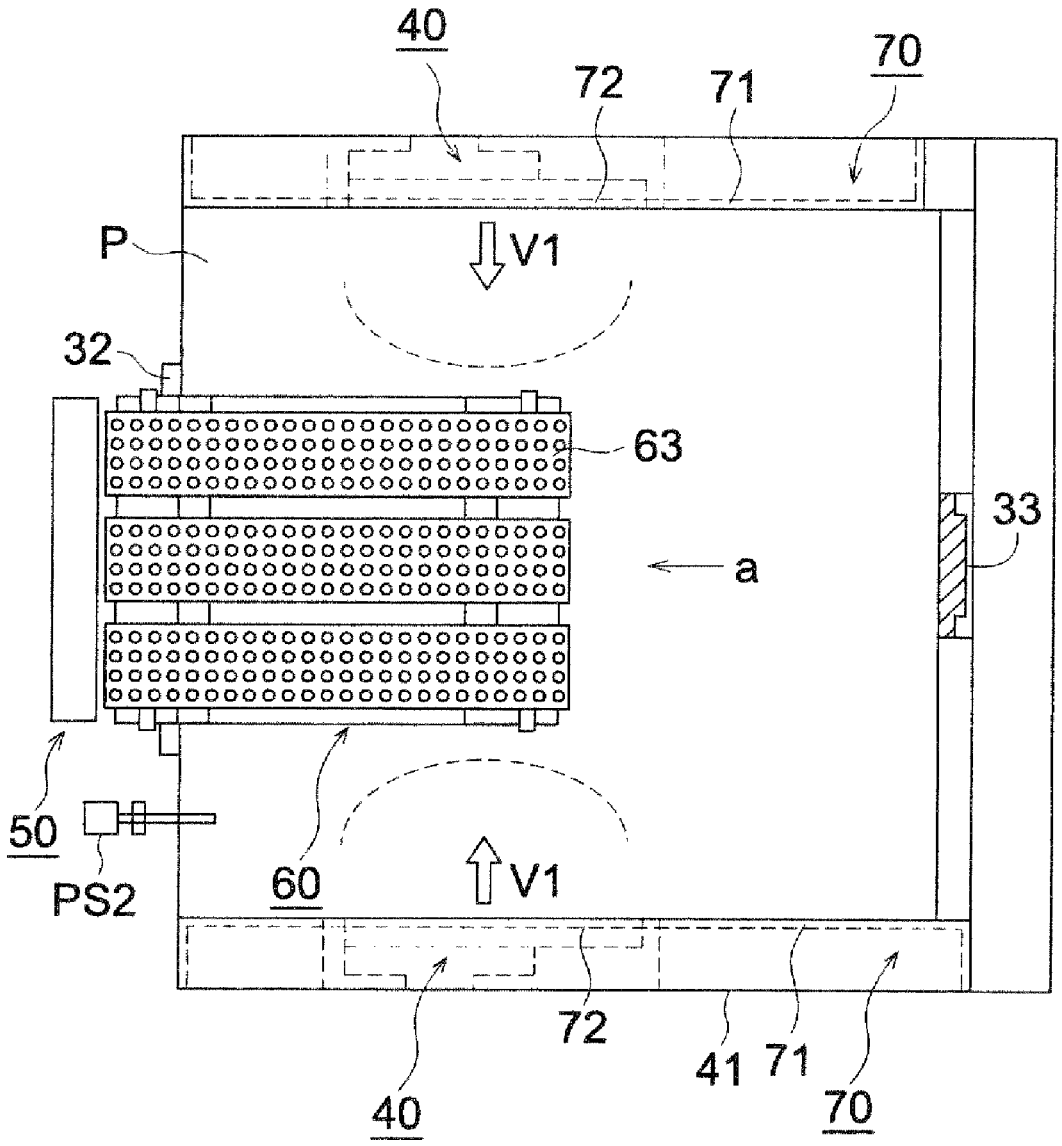
FIG. 4 is a plain view of the sheet feeding apparatus.
Figure 5:
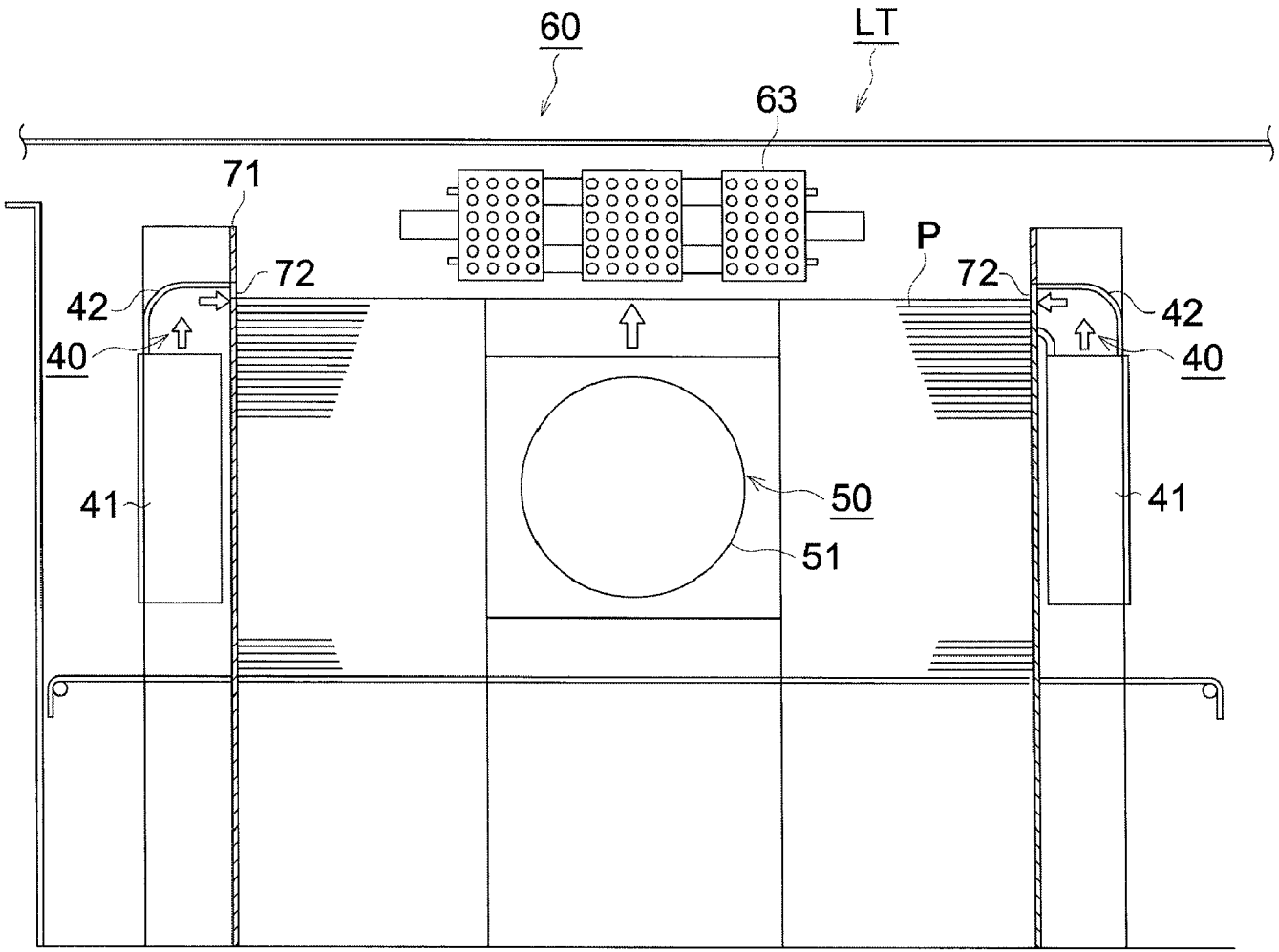
FIG. 5 is a side view of the sheet feeding apparatus.

FIG. 2 is a perspective view showing relevant portions of the large capacity sheet feeding apparatus LT of the present invention, FIG. 3 is a front cross-sectional view of the large capacity sheet feeding apparatus LT, and FIG. 4 and FIG. 5 are a plain view and a side view of the apparatus thereof.

In these figures, the stacked sheet bundle P is placed on the sheet feeding tray 31 and stored to be able to ascend and descend through an unillustrated mechanism. Also a pair of sheet side edge regulation devices 70 supports inward the sheet side edge regulation member 71 in contact with the side edges of the stacked sheet bundle P to regulate the sheet bundle P. The pair of sheet side edge regulation devices 70 can universally change a relative distance in a width direction perpendicular to a feeding direction so as to determine a position of the sheet bundle P in the width direction in accordance with the sheet size.

The sheet side edge regulation device 70 forms a box structure with high strength and rigidity, which is long enough in the sheet feeding direction. A gap between the sheet side edge regulation member 71 and side edges of the sheet is maintained below a predetermined value in a large area across the side edges even at a top section of the sheet bundle P. As above the side edges of the sheets on the top position are severely regulated so as to enhance regulation accuracy of the fed sheet.

The sheet front edge regulation member 32, fixed at the sheet feeding apparatus main body 30, is to regulate the front edge of the sheet bundle P stacked in the sheet feeding direction.

A sheet rear edge regulation member 33 is movable in a longitudinal direction of the sheet so as to regulate the rear edge of the sheet in the feeding direction and is supported by the sheet feeding apparatus main body 30 to be able to displace in the sheet feeding direction.

Also, the sheet side edge regulation member 71 and the sheet rear edge regulation member 33 have sufficient height and shape so as to regulate the sheet lifted by air all the time.

Also, as FIG. 3 shows, the sheet rear edge regulation member 33 is provided with a height sensor PS3 to detect a height of the sheet on the top of the stacked sheet bundle on the sheet tray.

A top position of the sheet bundle P stacked on a bottom plate 34 of the sheet feeding tray 31 is maintained at an appropriate height, at which air blow is received, by a control device to be described based on a signal of the height sensor PS3. Namely, control to maintain the top section of the sheet at a predetermined height all the time is performed by driving an unillustrated hoisting motor based on a detected result of the height sensor PS3 shown in FIG. 3 so as to elevate the bottom plate 34 of the sheet feeding tray 31.

As FIG. 3 shows, a sheet suction conveyance device (sheet feeding device) 60 is disposed at a downstream side of the sheet bundle P stacked on the sheet tray in the sheet feeding direction. The sheet suction conveyance device 60 is provided with a large diameter roller 61 connected to a drive power source 65 and three suction belts 63 installed on two small diameter rollers 62 across the width direction to rotate.

The suction belt 63 has a number of through holes as FIG. 2 shows. A duct 64A of a suction device 64 is fixed inside the suction belt 63.

The suction device 64 is configured with the duct 64A and a suction fan 64B connected to the duct thereof. At a lower portion of the duct, an opening 64C is disposed facing each suction belt 63. The opening 64*c* determines an air suction position of the sheet suction conveyance device 60. The air suctioned is exhausted to back side via the duct 64A.

There can be a configuration such that the suction fun 64 B is fixed at the back of the sheet feeding apparatus main body 30 and connected to the sheet suction conveyance device 60 via a duct.

The suction fun 64B operates all the time. The sheet suction conveyance device 60 suctions a lifted sheet on the top position to the suction belt 63 by a sheet separation mechanism of air blow to be described. The drive power source 65 is operated by the control device to be described, and the suction belt 63 rotates, then the aforesaid sheet is conveyed to an arrow a direction (downstream side of the sheet conveyance direction) and sent to the image forming apparatus main body A.

A sheet suction detection sensor PS1 is disposed at a vicinity of the opening 64C of the suction device 64 to detect that the sheet on the top has been suctioned.

A feed sensor PS2 is disposed at a vicinity of the suction belt 63 which is located at a downstream side of the sheet feeding tray 31 in the sheet conveyance direction so as to detect passage of the sheet to be fed.

Next, a sheet separating mechanism to separate each sheet by blowing air between the sheets for a group of sheets located in an upper portion of the sheet bundle P stacked on the sheet feeding tray 31 will be described as follow.

As FIG. 2 and FIG. 5 show, the first air blow devices 40 are disposed at both sides of the sheet feeding tray 31 so as to blow air towards the upper portion of the sheet bundle P stacked in the sheet feeding tray 31 laterally in a direction perpendicular to the sheet feeding direction. The first air blow device 40 is disposed at the sheet side edge regulation device 70 and configured with an air blow fan 41 and guide plates 42 so as to blow air towards the upper portion of the sheet bundle P from first air outlets 72 disposed at the sheet side edge regulation devices 70.

The air blow fan is mounted with an air outlet upward at the sheet side edge regulation device 70. The air exhausted upward changes its direction by 90 degrees by the guide plate 42, and is exhausted horizontally from the first outlet 72 of the sheet side edge regulation member 71.

The first air outlet 72 has almost the same width as that of an air outlet of the first air blow device 40, and the first air outlet 72 and the air outlet thereof is connected so that air does not leak out. It is preferred that a height of the first air outlet 72 is in a relation that the sheet P1 on the upper most layer of the sheet bundle comes to almost the center of the first air outlet 72. The height of the first air outlet 72 is determined appropriately for the reasons of a capacity of the air blow fan 41 and design of the guide plate 42.

As above, the first air outlet 72 and the first air blow device 40 are mounted at the sheet edge regulation device 70 to be capable of moving along with the sheet side edge regulation member 71. Therefore there is an advantage that a certain positional relation in respect to the sheet bundle P can be always maintained in accordance with change of sheet size.

As FIG. 3 shows, a plurality of exhaust outlets 73 are provided on a wall surface of the sheet side edge regulation member 71 positioned at an upstream side of the first air outlet 72 in the sheet feeding direction.

A configuration of the exhaust outlet 73 relates to a subject of the present invention i.e. "to provide a technology to maintain the posture of the sheet separated by air blow form the first air blow device in a stable condition for preventing duplicative feed". Detailed description is as follow.

Figure 9A:
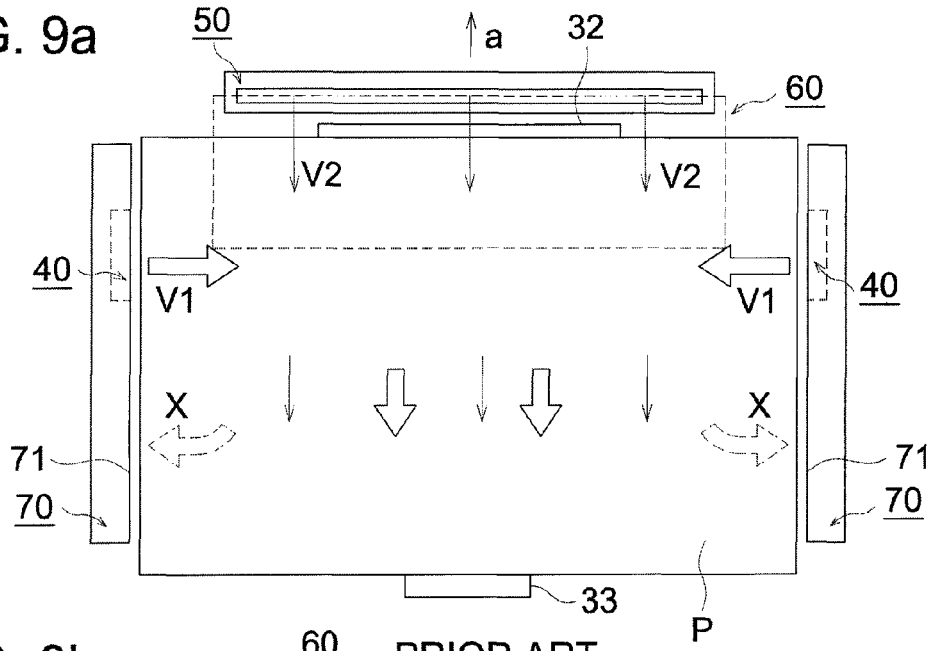
PRIOR ART FIG. 9a
FIGS. 9*a*, 9*b* and 9*c* are schematic diagrams showing air flows from the first air blow device and the second air blow device, and a posture of the sheet in a conventional technology.
Figure 9B:
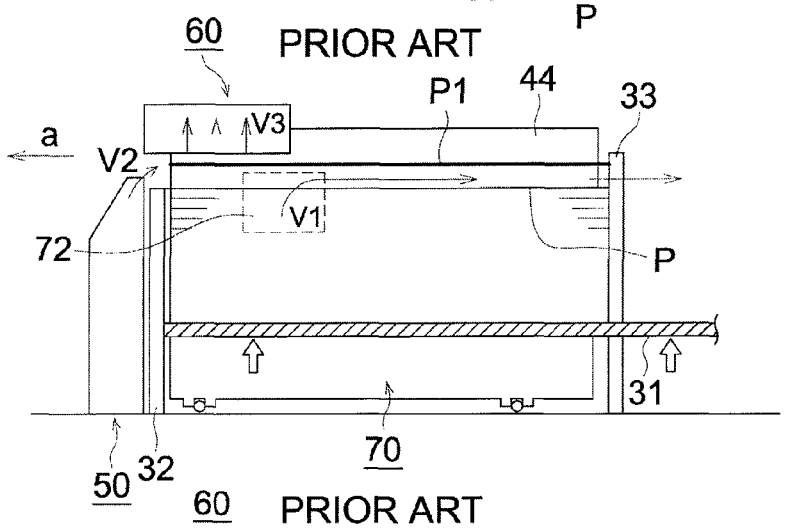
FIG. 9b PRIOR ART
Figure 9C:
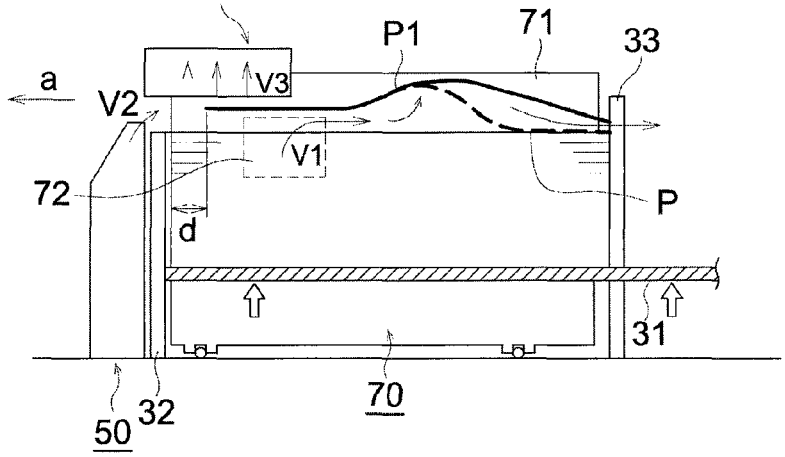
FIG. 9c PRIOR ART
Figure 10A:
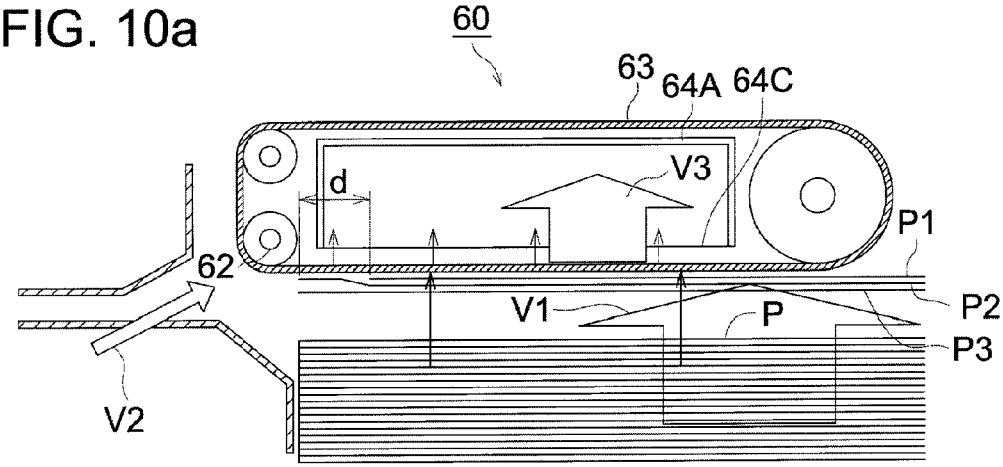
PRIOR ART FIG. 10a
FIGS. 10*a*, 10*b* and 10*c* are schematic diagrams showing a sheet suction conveyance process of separated sheets P1, P2 and P3 in a conventional technology.
Figure 10B:
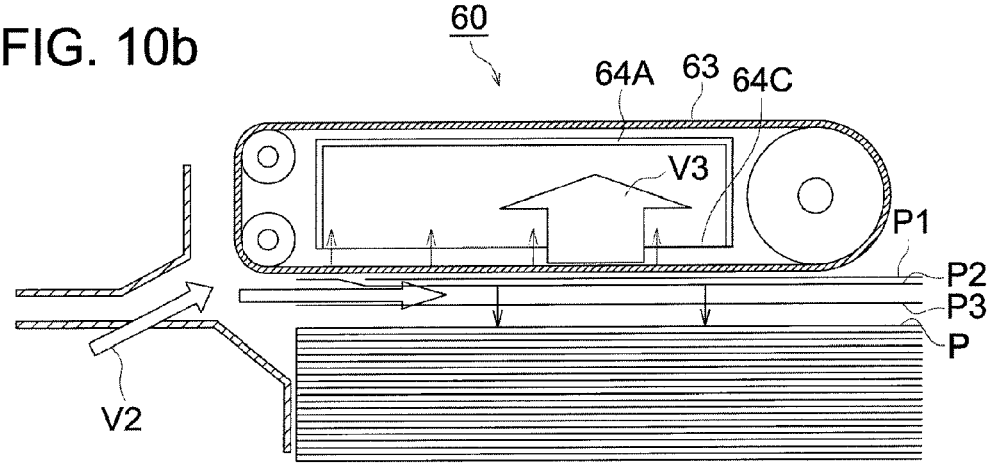
PRIOR ART FIG. 10b
Figure 10C:
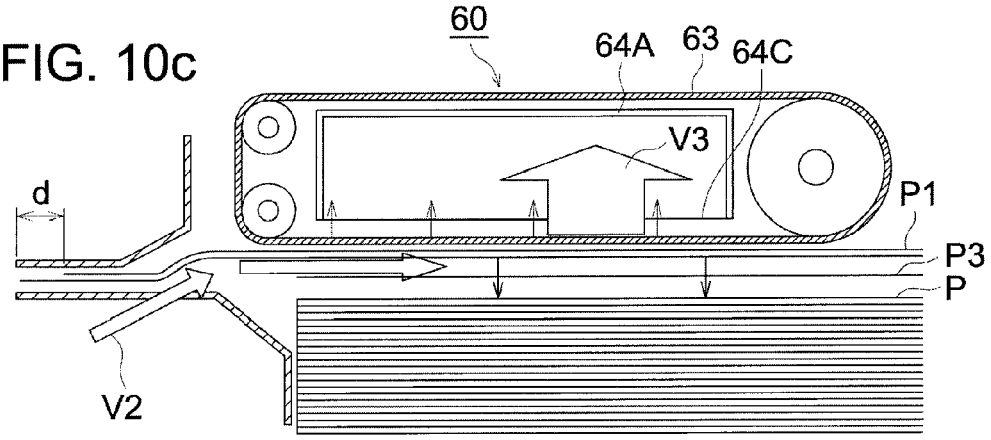
PRIOR ART FIG. 10c
Figure 11:
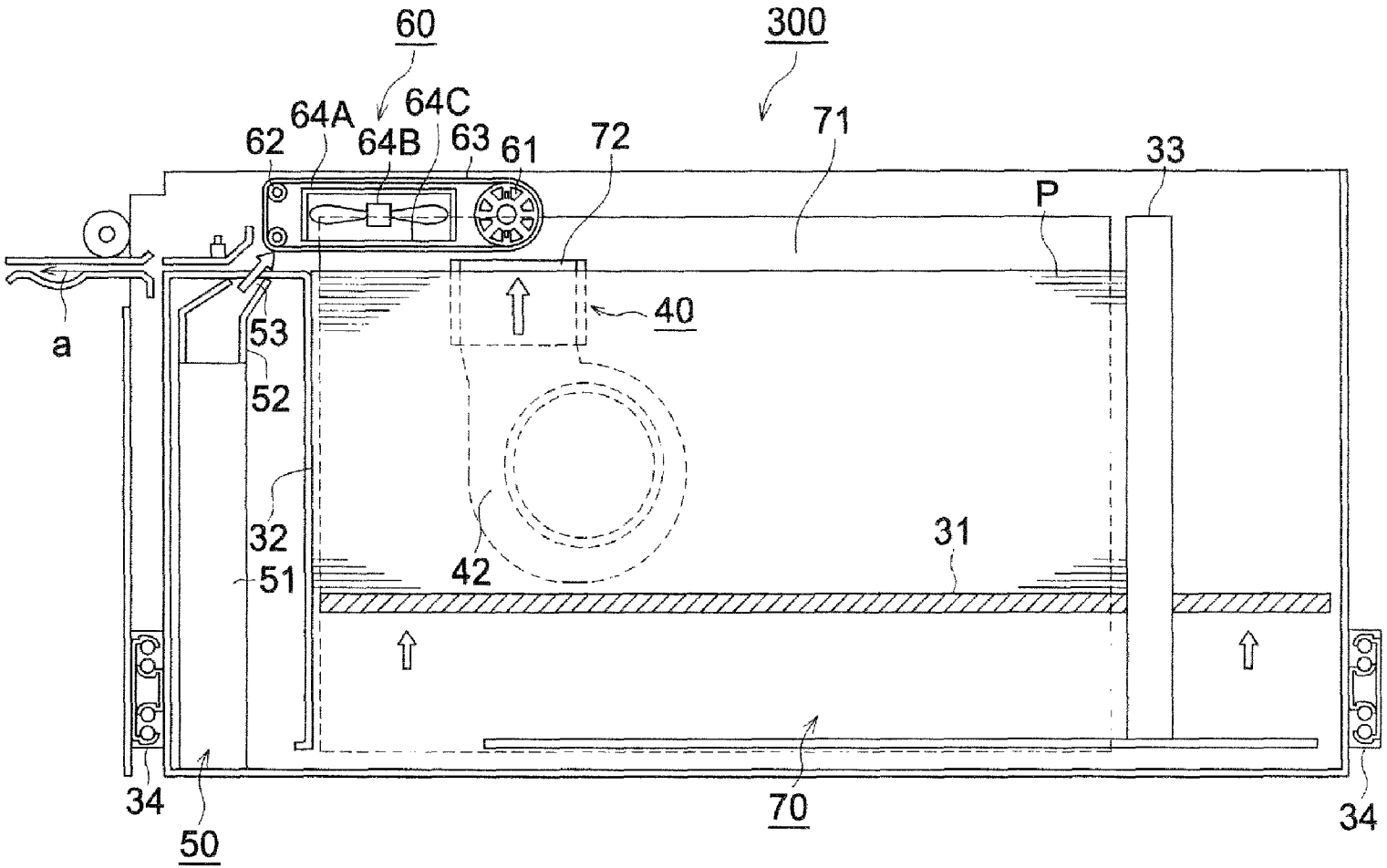
FIG. 11 PRIOR ART
FIG. 11 is a front center cross-sectional view of the sheet feeding apparatus main body of a conventional technology.

The exhaust outlet 73 is a plurality of elongated holes, elongated upward from a vicinity of the top section of the sheet bundle P1, which are arrayed with the same pitch. The exhaust outlet 73 prevents the sheet P1, on the top position separated from the sheet bundle P, from resulting in a posture described by the broken lines in FIG. 9*c*. The exhaust outlet 73 is provided with an air pressure adjusting function which appropriately blows air laterally in the direction perpendicular to the sheet feeding direction so that an air pressure against a lower surface of the sheet P1 does not increase excessively. Therefore, a posture such that the sheet P1 on the top position bends upward as FIG. 9*c* shows does not occur.

Namely, there is established a relation that as the air pressure for the lower surface of the sheet P1 increases and the sheet P1 bends upward largely, a shielding effect by the side edge of the sheet P1 at the exhaust outlet decreases and an exhaust air amount from the exhaust outlet 73 increases, as a result the air pressure against the lower surface of the sheet P1 decreases. As the above relation, the sheet P1 is always maintained in an almost desirable posture.

Therefore, even if an air blow force of the first air blow device 40 or the second air blow device 50 is increased so that the sheets at an upper portion of the sheet bundle P configured with the sheet having the high smoothness with less rigidity are sufficiently separated, the sheet bent to occur in each step of separation of the sheet P1 on the top position is always avoided.

As the result, it is presumed that prevention of duplicative feeding is attained because the separation area between the sheet P1 and the sheet P2 gradually expands while the sheet P1 is maintaining the desirable posture.

Figure 6A:
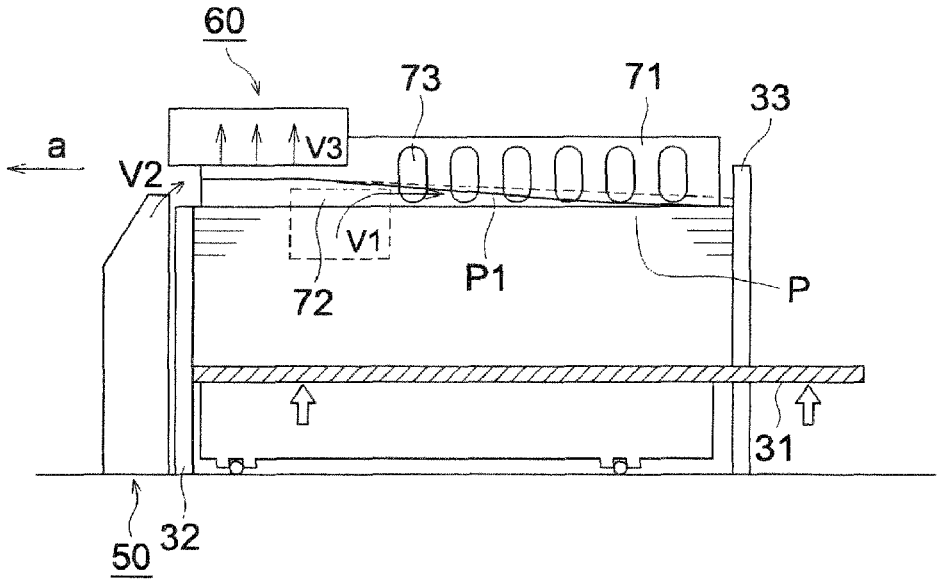
FIGS. 6*a* and 6*b* are schematic diagrams showing a posture of the sheet separated by a first air blow device and a second air blow device.

FIG. 6*a* is a schematic diagram showing a posture of the sheet P1 on the top position in the sheet feeding apparatus 30 related to the present invention. A solid line shows an initial stage of sheet feeding period, and the broken lines show a later stage. As the figures show, in each stage of the air separation period, the sheet P1 maintains the original posture except a slight bent of the rear edge side in an area which is suctioned by the sheet suction conveyance device 60.

Next, the second air blow device 50 disposed at a downstream side of the sheet feeding tray 31 in the sheet feeding direction with reference to FIG. 2, FIG. 3 and FIG. 5. FIG. 5 is a side view of the sheet feeding tray 31 viewed from the downstream side in the sheet feeding direction.

The second air blow device 50 is configured with an electric fan 51 and an air blow guide 52 connected to the electric fan 51. The second air blow device 50 blows air towards an uppermost portion of the front edge of the sheet bundle stacked on the sheet feeding tray through the second air outlet 53. The electric fan 51 is provided with an air blow guide 52 having an upward second air outlet 53.

The air blowing upward is exhausted from the second air outlet 53 located an upper oblique position. As FIG. 3 shows, the air exhausted from the second air outlet 53 blows obliquely from an upstream side in the sheet feeding direction towards the suction belt 63 of the sheet suction conveyance device 60.

The second air blow device 50 is configured so that the air blow force can be controlled in accordance with the kinds of the sheets P'. Namely, for an OHP film, a tracing paper, a coated sheet with a surface smooth, a sheet on which perforation or folding line is formed, and an offset printed sheet with powder, air blows between the sheets of the sheet bundle to ensure separation.

Figure 7A:
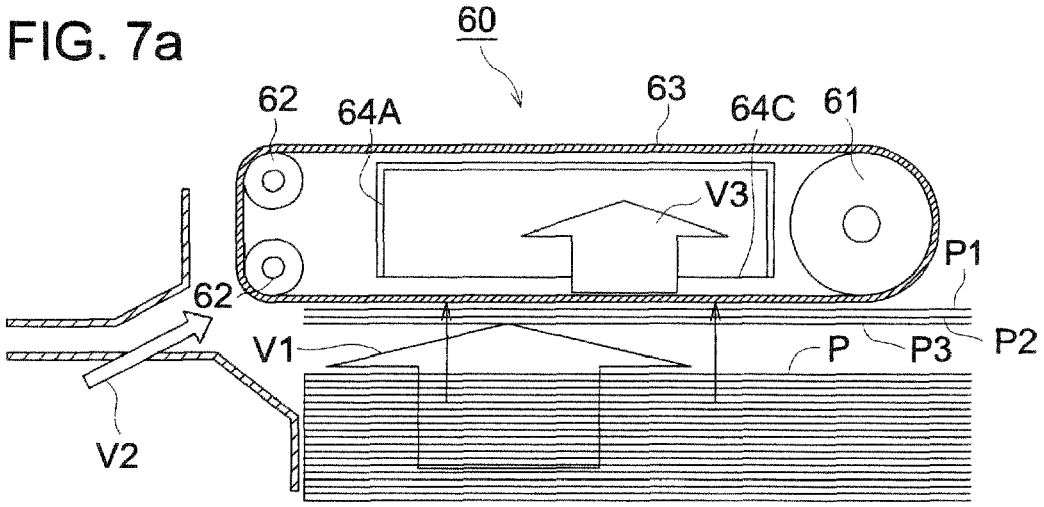
FIGS. 7*a*, 7*b*, and 7*c* are schematic diagrams showing a sheet suction conveyance process of separated sheets P1, P2 and P3.
Figure 7B:
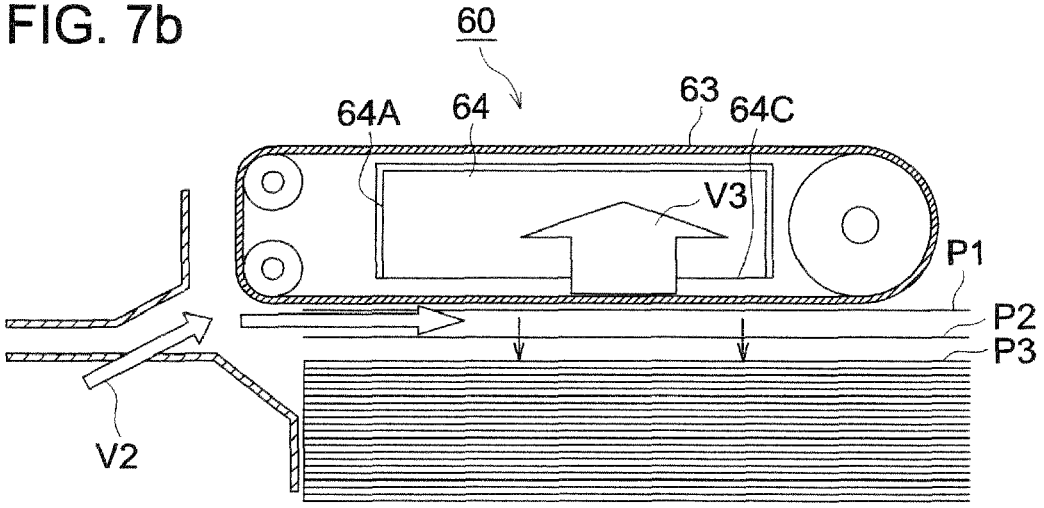
Figure 7C:
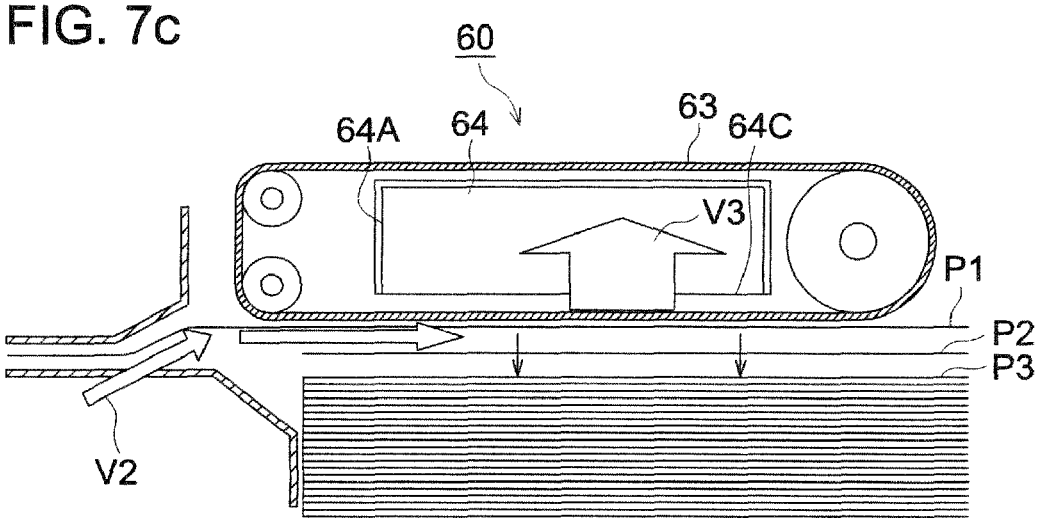
Figure 8:
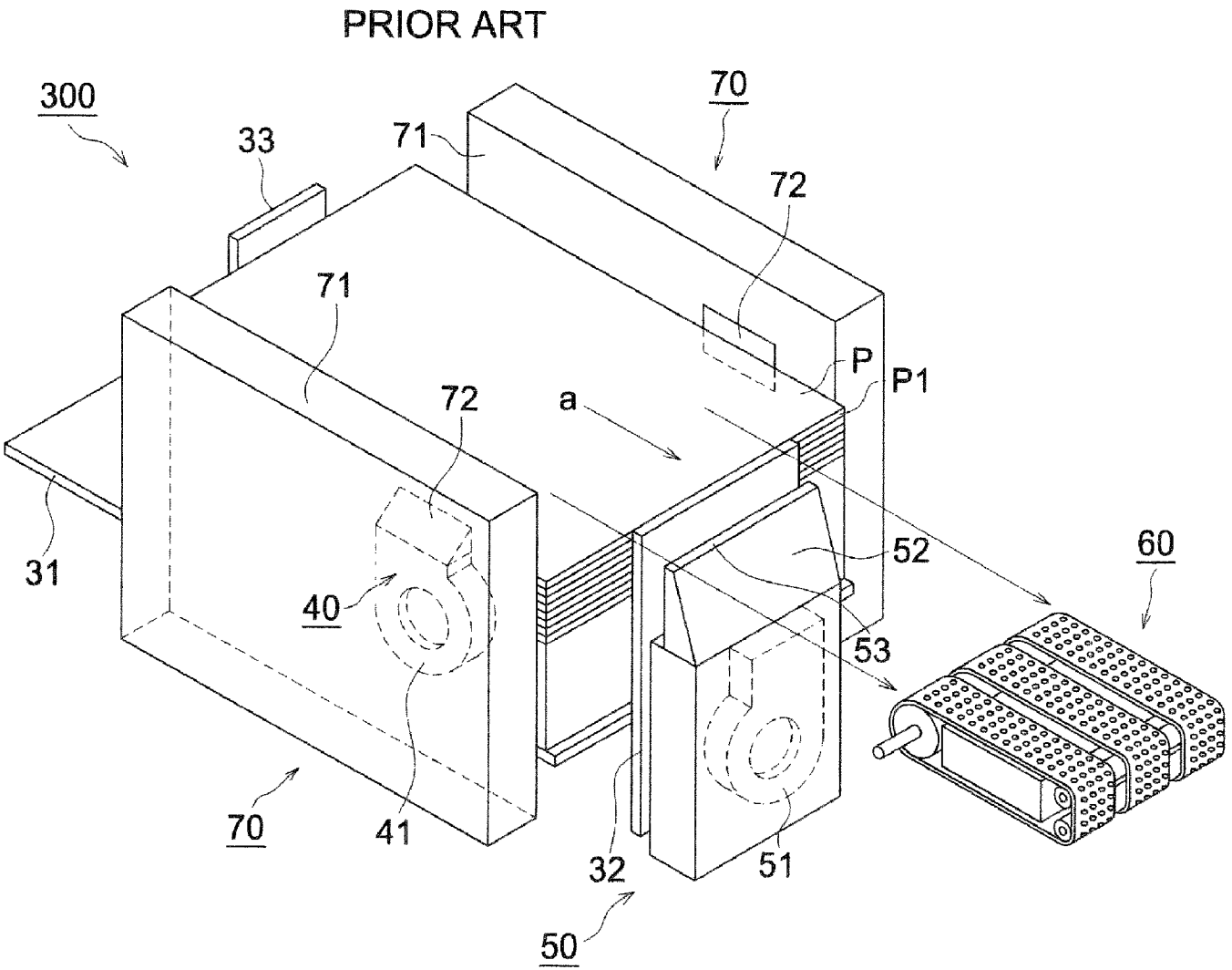
FIG. 8 is a perspective view showing relevant portions of a large capacity sheet feeding apparatus of a conventional technology.

FIG. 7*a*, FIG. 7*b* and FIG. 7*c* are schematic diagrams showing a process where the sheets P1, P2 and P3 separated from the sheet bundle P by the first air blow device 40 and the second air blow device 50 are suctioned by the sheet suction conveyance device 60 and conveyed.

FIG. 7*a* shows a state where the sheets P1, P2 and P3 are separated from the sheet bundle P and lifted by the first air blow device 40 and the second air blow device 50, and the sheet P1 on the top position is suctioned onto the sheet suction conveyance device 60. Several sheets P' at the upper part of the sheet bundle stacked on the sheet tray 31 are lifted by a first air flow V1 (an outline arrow in the figure) blown upward by the first air blow device 40 against the weight of the sheets. Then only the sheet P1 on the top position is suctioned onto the suction belt 63 through a suction air V3 (outline arrow in the figure) by a negative pressure of the suction belt 63.

In the sheet feeding apparatus main body 30 related to the present invention, the sheet P1, on the top position blown up by the first air blow device 40, is suction at a predetermined position on the sheet suction conveyance device 60 while maintaining the desirable posture described by the solid line in FIG. 6*a* as above. Therefore, the duct opening 64C is blocked completely by the sheet P1 as the result, the suction air V3 of the sheet suction conveyance device 60 does not affect the sheets P2 and P3.

Figure 6B:
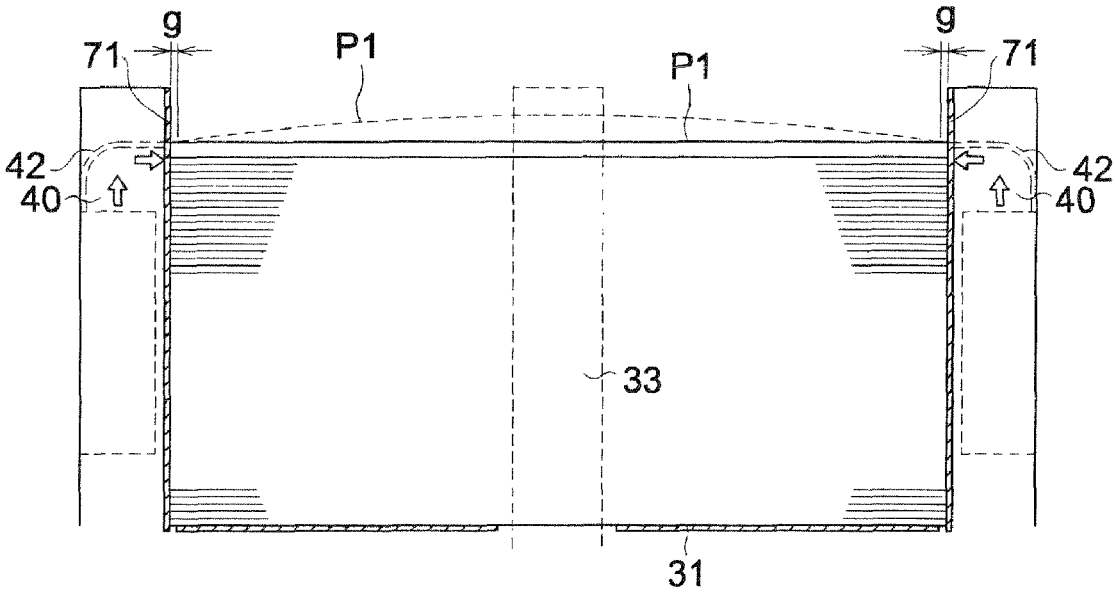

FIG. 6*b* shows a separation process of the sheets P1, P2 and P3 by the second air blow device 50.

The sheet P2 is infallibly separated from the Sheet P1 by progress of air in an arrow direction between the sheet P2 and sheet P1 with a second air blow V2 (an outline arrow in the figure) blown up by the second air blow device 50 without being affected by the suction air V3 of the suction belt 63. At the same time, the sheet P2 is in a state to be forced to the upstream side of the sheet feeding direction. The sheet P3 is also in the same state.

On the other hand, sheet P1 is suctioned and held by the suction belt 63 to maintain a posture described by the broken lines in FIG. 6*a*. Thereafter, when unillustrated drive device of the sheet suction conveyance device 60 is started to drive at a predetermined timing by the control device, only the sheet P1 on the top position suctioned by the suction belt 63 is conveyed to the downstream side. Then only the sheet P1 is led to the image forming apparatus main body A.

As described in the forgoing, the sheet feeding apparatus related to the present invention can attain a superior sheet feeding performance wherein miss feed such as non feed and duplicative feed are avoided for a wide range of sheets from a smooth paper to a regular paper under a wide range of environmental conditions including a high humidity environment.

For example, the sheet feeding apparatus related to the present invention is capable of smooth papers such as an OHP film, a tracing paper, a coated sheet having a smooth surface, and particular kinds of sheets such as a sheet on which perforations or folding lines are formed, and an offset printed sheet with powder as well as a regular sheet naturally.

The sheet feeding apparatus related to the present invention can realize a superior performance in respect to bias and skew of a fed sheet, compared to a conventional sheet feeding apparatuses.

FIG. 6*b* is a side view of the sheet feeding apparatus main body 30 related to the present invention viewed from an upstream side in the sheet feeding direction showing a posture of the sheet P1 on the top position separated by air from the first air blow device 40 and the second air blow device 50.

A solid line shows the sheet P1 on the top position in the feeding apparatus related to the present invention. The solid line shows a flat posture in a width direction perpendicular to the sheet feeding direction.

Broken lines show a posture of the sheet P1 on the top position in the sheet feeding apparatus 300 of a conventional technology. In the sheet feeding apparatus 300, since the air flow is strong at a center section and weakens toward both sides, there is a tendency that the center section bends upward. Therefore, as FIG. 6*b* shows, gaps between the sheet side regulation member 71 and the side edges of the sheet increases.

In the example shown by the figure, gaps g are created respectively at both sides, and the sheet fed to the image forming apparatus main body A displaces within a range of 2 g in a width direction perpendicular to the sheet feeding direction. Namely a bias of sheet in the conventional sheet feeding apparatus increases an amount equivalent to 2 g at maximum compared to the sheet feeding apparatus related to the present invention.

Further, by occurrence of such gaps, a failure such as "sheet skew" where the sheet is fed obliquely in respect to the feeding direction is naturally increased.

As above, in the sheet feeding apparatus of the present invention, since the sheet separated form the sheet bundle P by air can maintain an original posture of the sheet, a position of the sheet can be regulated in an almost ideal form through the sheet side edge regulation member 71 and the sheet rear edge regulation member 33 and conveyed to the image forming apparatus main body A through the sheet suction conveyance device (sheet feeding device) 60. Therefore, the image forming apparatus main body A to receive the sheet form the sheet feeding apparatus main body 30 related to the present invention can stably provide prints superior in positional accuracy (regulate) of the printed image in respect to the sheet gister.

Also, the sheet feeding apparatus related to the present invention can attain sheet feeding performance which ensures to omit duplicative feed and miss feed even if the sheets having a high smoothness such as coated sheets are stacked under a condition of high humidity.

What is claimed is:

1. A sheet feeding apparatus, comprising:

a sheet feeding tray to stack a sheet bundle configured with a plurality of sheets;

a sheet feeding device to convey the plurality of sheets one by one from a top position of the sheet bundle stacked on the sheet feeding tray;

a plurality of first air blow devices to flow air between the plurality of sheets by blowing air towards respective side edges of the sheet bundle so as to separate a sheet from the sheet bundle; and a plurality of sheet side edge regulation members to regulate the side edges of the sheet bundle, respectively;

wherein each of the sheet side edge regulation members comprises:

an air outlet to blow air from one of the first air blow devices to one of the side edges of the sheet bundle; and a plurality of exhaust outlets, which are provided on a side-edge-regulation wall surface of the sheet side edge regulation member, and which are disposed at an upstream side in a sheet feeding direction with respect to the air outlet, to exhaust air remaining between the sheet separated from the sheet bundle and the sheet bundle;

wherein the sheet side edge regulation members are moveable to change relative distances with respect to the side edges of the sheet bundle in a width direction of the sheet which is perpendicular to the sheet feeding direction so as to contact the side edges of the sheet bundle.

2. The sheet feeding apparatus of claim 1, further comprising:

a second air blow device to flow air between the sheets by blowing air towards another edge of the sheet bundle so as to separate the sheet from the sheet bundle;

wherein the second air blow device is disposed at a downstream side in the sheet feeding direction with respect to the sheet bundle stacked on the sheet feeding tray.

3. The sheet feeding apparatus of claim 1, further comprising a sheet rear edge regulation member to regulate an edge section of the sheet bundle at an upstream side in the sheet feeding direction.

4. An image forming apparatus, comprising:

an image forming section to form an image on a sheet; and the sheet feeding apparatus of claim 1 to feed the sheet to the image forming section.

5. The sheet feeding apparatus of claim 1, wherein the sheet feeding device comprises a suction belt and a suction device, and wherein the sheet separated by the plurality of first air blow devices is suctioned onto the suction belt and conveyed.

6. The sheet feeding apparatus of claim 1, wherein in each of the sheet side edge regulation members, the air outlet is disposed at a downstream side in the sheet feeding direction with respect to the sheet bundle stacked on the sheet feeding tray.

* * * * *